United States Patent [19]

Gillum

[11] Patent Number: 4,689,912

[45] Date of Patent: Sep. 1, 1987

[54] HAND-HELD HIGH-VELOCITY GRENADE LAUNCHER

[75] Inventor: Richard R. Gillum, Marblehead, Ohio

[73] Assignee: Weapon Technology System R & D Ltd., Westlake, Ohio

[21] Appl. No.: 878,673

[22] Filed: Jun. 26, 1986

[51] Int. Cl.[4] ..... F41C 15/08; F41F 19/06

[52] U.S. Cl. ..... 42/105; 42/23; 42/70.05; 42/70.06; 42/47; 42/69.01; 89/44.01

[58] Field of Search ..... 42/105, 106, 23, 25, 42/14, 69.01, 46, 47, 70.08, 70.07, 70.06, 70.05, 70.04; 89/1.7, 1.704, 1.705, 178, 44.01

[56] References Cited

U.S. PATENT DOCUMENTS

| | | | |
|---|---|---|---|
| 104,775 | 6/1870 | Rydbeck | 42/23 |
| 1,972,763 | 11/1933 | Dutton | 42/70.08 |
| 2,363,675 | 11/1944 | Johnson, Jr. | 42/105 |
| 2,701,963 | 2/1955 | Balleinsen et al. | 89/44.01 |
| 3,052,053 | 9/1962 | Vartanian | 42/14 |
| 3,343,294 | 9/1967 | Wahl | 42/46 |
| 4,579,037 | 4/1986 | Gillum | 89/180 |

FOREIGN PATENT DOCUMENTS

| | | | |
|---|---|---|---|
| 348338 | 9/1960 | Fed. Rep. of Germany | 42/23 |
| 506115 | 10/1951 | France | 89/1.705 |

*Primary Examiner*—Deborah L. Kyle
*Assistant Examiner*—Michael J. Carone
*Attorney, Agent, or Firm*—Pearne, Gordon, McCoy & Granger

[57] ABSTRACT

A hand-held, single-shot grenade launcher including a receiver and attached stocks for both hands, a barrel slidable in the receiver, an assembly of Belleville springs for absorbing recoil and a breech connected to the end of the barrel. A grenade round is manually inserted in a firing chamber defined by the breech and the inner end of the barrel and cammed into firing position by a sliding breech block that carries a pivotal firing lever operated by a striker mounted in the receiver. The striker is biased by a helical striker spring and is cocked by a cocking lever associated with the right hand grip. The weapon is fired by depressing the cocking lever and thus pulling the trigger to cam the striker upward and release it from a sear operated by the cocking lever. Upon release the striker impacts an arm of the firing lever to drive a firing pin carried by the other arm of the firing lever into the primer of the grenade round casing.

6 Claims, 3 Drawing Figures

HAND-HELD HIGH-VELOCITY GRENADE LAUNCHER

BACKGROUND OF THE INVENTION

This invention relates to hand-held weapons for firing grenade rounds and the like. More particularly, the invention relates to a gas propulsion system for launching a high-velocity grenade round using a lightweight, single-shot, dedicated weapon adapted to be carried and fired by a single grenadier.

Modern high-velocity grenades are typically around 40 mm in size and comprise a cartridge containing the propellant and a head adapted to explode upon impact. The head may be designed for various military uses such as antipersonnel use, antitank use and others (e.g. smoke grenade).

Earlier attempts to shoulder fire high-velocity grenades from a hand-held, single-shot weapon have often failed for the reason that even when the recoil force was attenuated, the reaction on the shoulder of the grenadier was intolerable. The structure of the human shoulder joint even in large individuals of great strength is not adequate to endure the high impact forces necessarily generated when a grenade round is fired. Also due to the size and weight of prior art high-velocity grenade launchers, accurate sighting and placement of the rounds has been quite difficult. Usually the firing generates forces that produce a moment tending to jerk the weapon out of accurate alignment, thus destroying the aim.

Recent improvements in the design of weapons to improve the ease of handling and accuracy are shown in my U.S. Pat. Nos. 4,321,765 and 4,579,037, the disclosures of which are incorporated by reference herein and made a part hereof. The holding apparatus described and shown in both of those patents is incorporated in the design of the grenade launcher of the present invention.

Briefly, that holding apparatus includes separate right hand and left hand stocks, the right hand stock being a generally conventional pistol grip wherein the trigger finger is placed through the trigger guard in a position to squeeze the trigger. The weapon is held in a generally horizontal position with the right hand stock extending laterally to the right so that the operator's right hand wrist axis is horizontal. The left hand stock extends from the opposite side of the weapon and includes a left hand grip so formed that the grenadier's left hand wrist axis is generally vertical. Accordingly, the operator's wrist axes are perpendicular to one another, thus providing an improved capability for controlling the weapon.

Since the human body can tolerate extremely high forces on the palm of the hand—much higher, for example, than on the shoulder joint, the stocks of the present weapon take advantage of this feature and enable the grenadier to fire much higher impulse rounds than ever before.

Also the method of holding places the axis of the weapon in the plane of the grenadier's arms. This puts the arms in direct compression with little or no tendency to rotate any of the major joints of the body. In other words, the recoil force does not tend to rotate the wrist, elbow, shoulder or waist. Thus, the design presented herein takes advantage of these facts and the recoil is taken by the palm of the hands in a manner that does not induce rotation in the primary joints of the body.

Another less obvious advantage of the method of holding stems from the fact that the axes of the wrists are at right angles to one another. In this manner, the strong axis of each wrist reinforces the weak axis of the other. This promotes an extremely steady aim or holding of the weapon.

The weapon of the present invention not only resolves the difficulties and disadvantages indicated above but also affords other features and advantages heretofore not obtainable.

SUMMARY OF THE INVENTION

It is among the objects of the present invention to provide a single-shot high-velocity grenade launcher that may be readily operated by a single grenadier.

Another object of the invention is to provide a hand-held grenade launcher with improved firing accuracy.

A further object is to improve the controlability of a hand-held high-velocity grenade launcher adapted to be supported at eye level in a visually-sighted position.

These and other objects and advantages are achieved with the novel hand-held grenade launcher design of the present invention. The weapon includes a receiver or frame to which right hand and left hand stocks are mounted, a barrel slidably received in the receiver and an annular recoil spring assembly interposed between an annular external shoulder formed on the forward portion of the barrel and the receiver to absorb recoil forces. A breech is connected at the rearward end of the barrel and defines with the barrel a firing chamber adapted to receive a grenade round to be fired.

In accordance with the invention, a breech block is slidably mounted in the breech for movement in a lateral direction between an open position to permit end loading of the grenade round into the firing chamber and a closed position closing the firing chamber and retaining the round in firing position. The round is fired by means of a firing lever pivotally mounted in the breech block by a pin and having a first lever arm with a firing pin thereon axially aligned with the barrel. The firing lever has a second lever arm that extends downwardly for engagement by a striker slidably mounted in the receiver for movement in a direction parallel to the axis of the barrel and adapted to impact against the lever and pivot the firing pin against the casing.

A trigger device is mounted in the receiver for cocking and releasing the striker so that the striker when released will move sharply rearwardly and impact the second lever arm to fire the round.

DETAILED DESCRIPTION OF THE PREFERRED EMBODIMENT

Figure 1:
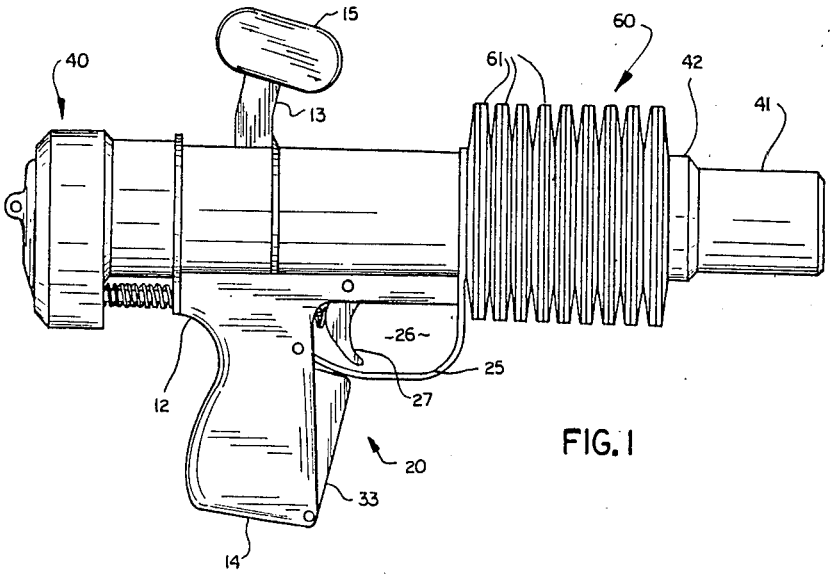
FIG. 1 is a plan view of the hand-held single-shot high-velocity grenade launcher of the invention.
Figure 2:
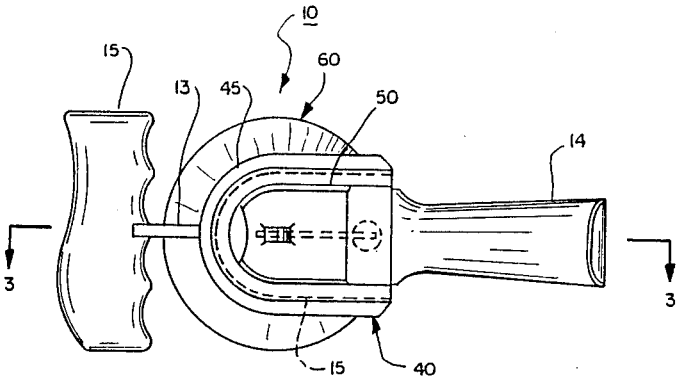
FIG. 2 is a rear end elevation of the grenade launcher of FIG. 1.

Referring more particularly to the drawings, there is shown a hand-held, single-shot, high-velocity grenade launcher 10 embodying the invention and adapted to receive a forty millimeter grenade 11 axially loaded through the breech.

The weapon includes as its primary components a receiver and trigger assembly 20, a barrel-and-breech assembly 40 and a recoil spring assembly 60. The launcher 10 is adapted to be held at an eye level, visual sighting position by means of a right hand stock 12 of generally conventional design and a left hand stock 13 both of which form an integral part of the receiver and trigger assembly 20. The arrangement of the stocks 12 and 13 and the respective grips 14 and 15 as indicated above embodies the design of my U.S. Pat. No. 4,321,765. The grip 14 is secured to the right hand stock 12 by a machine screw 16.

The right hand stock 12 is fixed to the receiver at one side of the barrel axis such that the trigger finger may be used to operate the trigger in a conventional manner but with the right hand wrist in a horizontal plane, unlike the conventional vertical position. The left hand stock 13 is fixed to the receiver on the opposite side of the barrel axis in alignment with the right hand stock 12. However, the left hand stock 13 has a grip 15 that is adapted to be held in such a way that the operator's left hand wrist axis is perpendicular to the operator's right hand wrist axis. This divides the firing recoil between the user's hands in a generally symmetrical manner to provide improved control. The grips 14 and 15 are preferably formed of a molded plastic material.

RECEIVER AND TRIGGER ASSEMBLY

Figure 3:
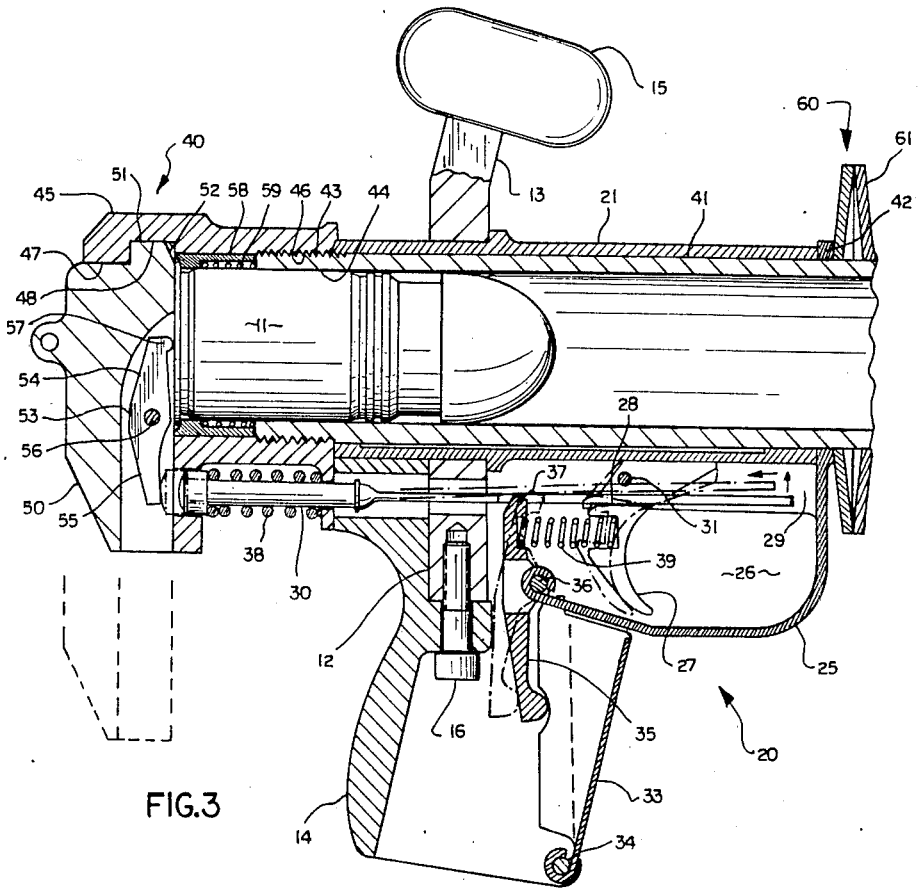
FIG. 3 is a fragmentary sectional view on an enlarged scale taken on the line 3—3 of FIG. 2 showing a 40 mm grenade loaded in the firing chamber preparatory to firing.

Referring to FIG. 3, the receiver-and-trigger assembly 20 includes a main body portion 21 machined from steel stock and being of cylindrical tubular form to receive the barrel 41 which slides freely therein. The receiver body 21 serves as a base for, and is integral with, the stocks 12 and 13.

The assembly 20 also includes a trigger guard 25 that defines an opening 26 for the trigger finger of the operator and the trigger 27 itself. Located above the opening 26 is a channel 29 adapted to receive a striker 30 and the trigger pivot pin 31. The upper portion of the trigger 27 has a cam portion 28 which bears against the striker 30 and is adapted to lift it (and thus release it from a cocked position) when the trigger is pulled.

The right hand grip 14 is of hollow construction and has a cocking lever 33 that pivots about a pivot pin 34. The cocking lever 33 is adapted to engage a sear 35 also mounted in the right hand grip 14 for pivotal movement about a pivot pin 36. The upper end of the sear fits in a slot 37 formed in the striker 30 and is adapted to move the striker in an axial direction.

The cocking lever 33 when depressed pivots the sear 35 to pull the striker 30 forwardly against the striker spring 38 to a cocked position. The lever 33 must be held in a depressed position in order for the launcher to be fired. When the trigger 27 is depressed the cam portion 28 raises the striker above the upper end of the sear and thus releases it so that it is urged by the striker spring 38 rapidly in a rearward direction to operate the firing mechanism to be described below.

A helical sear spring 39 bears between the upper arm of the sear 35 and the trigger 27 to urge the sear (and thus the cocking lever 33) to its uncocked position and to urge the trigger to its forward ready position.

Barrel and Breech Assembly

The barrel and breech assembly 40 includes a barrel 41 slidably received in the receiver 21 and having an annular shoulder 42 formed near its forward end. The recoil spring 60 is located between the shoulder 42 and the forward end of the receiver 21 so that during recoil the spring 60 is depressed to attenuate the recoil force.

The inner end of the barrel 41 is provided with external threads 43 so that the barrel may be threaded into the breech 45 which is provided with internal threads 46. The breech 45 has an opening 47 formed at its rearward end to permit end loading of the grenade round 11 into the firing chamber 44 defined by the end of the barrel 41 and the breech 45.

After a grenade round 11 is loaded into the firing chamber 44, the chamber is closed by a sliding breech block 50 with an edge that defines a perimetric lip or key 51 that slides in a perimetric channel or slot 48 formed in the breech. The upper interior edge of the breech block 50 is provided with a cam surface 52. As the breech block 50 is slid from its open position (shown in dashed lines in FIG. 3) to its closed position (shown in solid lines in FIG. 3), it cams against the grenade round 11 to tightly seat the round in the firing chamber.

The breech block 50 serves as a support for a pivotal firing lever 53 with a pair of oppositely extending lever arms 54 and 55 that pivot about a pivot pin 56. The upper end of the firing lever 53 has a firing pin 57 formed thereon in axial alignment with the barrel and adapted to engage the primer of the grenade round 11.

A cylindrical ejector sleeve 58 is slidably mounted in the breech 45 at a location in the firing chamber 44 wherein it surrounds the casing portion of the grenade 11. A helical ejector spring 59 is seated between an annular shoulder portion of the sleeve 58 and the rearward end of the barrel 41. The spring 59 urges the ejector sleeve 58 in a rearward direction against the rim of the casing so that, after a round is fired and the breech block is slid to its open position, the sleeve and spring push the casing out of the firing chamber 44 sufficiently to permit the casing to be manually removed.

Recoil Spring Assembly

The recoil spring assembly 60 comprises a number of Belleville springs 61 arranged in tandem. This provides an assembly capable of handling a relatively high recoil load with a relatively small deflection.

Operation

In a typical operation of the weapon such as when firing from a standing position the grenadier slides the breech block 50 to the open position (dashed lines FIG. 3) and inserts the 40 mm grenade round 11 into the firing chamber 44. Then the grenadier closes the breech block which cams the grenade round tightly into position in the firing chamber.

The grenadier then holds the weapon in a position with the stocks 12 and 13 extending laterally on opposite sides and with his wrist axes perpendicular to one another. He sights along the barrel 41 using optional front and rear sights (not shown) and squeezes the cocking lever 33. As this is done, the sear 35 pivots about its pivot pin 36 and urges the striker 30 in a forward direction compressing the striker spring 38 to cock the mechanism.

When the grenadier depresses the trigger 27 against the force of the sear spring 39 (while still depressing the cocking lever 33) the cam 28 urges the striker upwardly to disengage the upper end of the sear from the slot 37. This releases the striker 30 and the striker spring 38 forces the striker sharply in a rearward direction to impact against the arm 55 of the firing lever 53. Consequently the other arm 54 of the firing lever sharply drives the firing pin 57 against the primer of the grenade to ignite the charge and fire the grenade through the barrel.

The recoil force produced by the expanding gases urges the barrel and breech assembly 40 sharply in a rearward direction. The recoil force however is resisted by the recoil spring 60 to attenuate the recoil force sufficiently to minimize the impact experienced by the grenadier. After the firing is completed the grenadier slides the breech block laterally whereupon the ejector spring 59 and sleeve 58 urge the spent cartridge out of the firing chamber sufficiently to permit manual removal. This clears the chamber for insertion of a new cartridge.

It will be noted that the unique results obtained by this construction enable the shooter to launch high impulse rounds with a lightweight weapon while greatly facilitating the holding and aiming of the weapon. Also the arrangement of the left hand and right hand stocks facilitates an accurate aiming of the device and thus a more accurate placement of the grenade round by the grenadier.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A hand-held, single-shot weapon for firing a high-velocity grenade round comprising:

a receiver;

stocks associated with said receiver for gripping said weapon for firing;

a barrel slidably received in said receiver and having an annular external shoulder spaced forwardly of said receiver;

annular recoil spring means surrounding a portion of said barrel and operatively located between said shoulder and the forward end of said receiver;

a breech connected to the rearward end of said barrel and defining with said barrel a firing chamber adapted to receive a grenade round to be fired;

a breech block received in said breech and manually slidable between an open position to permit end loading of a grenade round into said firing chamber and a closed position closing said firing chamber;

a firing lever pivotably mounted in said breech block about a transverse axis and having a first lever arm with a firing pin thereon axially aligned with said barrel and a second lever arm;

a striker slidably mounted in said receiver for movement in a direction parallel to the axis of said barrel and adapted to engage said second lever arm of said firing lever; and striker spring means urging said striker toward said second lever arm;

a sear engagable with said striker and movable in one direction to move said striker against said striker spring means;

trigger means including a trigger spring having one end engaging said sear;

cocking means operable by the user when gripping the weapon for firing, to move said sear in one direction to a cocked position and to cause said sear to compress said trigger spring; and said trigger means being operable by the user to disengage said striker from said sear when said sear is in the cocked position whereby said striker means is moved into the cocked position only when the weapon is gripped for firing and when said striker means is released, said striker means impacts against said second lever arm to pivot said firing pin sharply to impact against and fire said grenade round.

2. A weapon as defined in claim 1, wherein said recoil spring means comprises a plurality of Belleville spring elements.

3. A weapon as defined in claim 1, wherein said breech block slides in a direction perpendicular to the axis of said firing lever.

4. A weapon as defined in claim 3, wherein said breech block has a cam surface formed therein to engage during closing movement a rearward portion of the casing of a grenade round manually inserted in said breech whereby sliding movement of said breech block to its closed position cams said round firmly into firing position in said breech.

5. A weapon as defined in claim 1 further including an ejector element mounted in said firing chamber for sliding movement relative to said breech in a direction parallel to the axis of said barrel and engaging with and moving rearwardly the casing of a fired grenade round after the breech block is opened and spring means urging said ejector element in a rearward direction.

6. A weapon as defined in claim 5, wherein ejector element comprises an annular sleeve coaxially received in said breech.

* * * * *